United States Patent [19]

Peyton

[11] 4,448,264

[45] May 15, 1984

[54] GROUND ROD DRIVING POLE

[76] Inventor: Jackie W. Peyton, 911 Husbands Rd., Paducah, Ky. 42001

[21] Appl. No.: 325,592

[22] Filed: Nov. 27, 1981

[51] Int. Cl.[3] ..... B25D 1/00

[52] U.S. Cl. ..... 173/52; 173/126; 173/129

[58] Field of Search ..... 173/52, 126, 90, 115, 173/18, 128, 129, 132, 131

[56] References Cited

U.S. PATENT DOCUMENTS

| | | | |
|---|---|---|---|
| 2,693,086 | 11/1954 | Caruthers et al. . | |
| 2,802,340 | 8/1957 | Tallman . | |
| 2,998,087 | 8/1961 | Iddings | 173/126 X |
| 3,073,571 | 1/1963 | Wunsch . | |
| 3,115,199 | 12/1963 | Linabery | 173/126 |
| 3,412,812 | 11/1968 | Kindsfater | 173/52 X |
| 3,499,497 | 3/1970 | Moore . | |
| 3,712,389 | 1/1973 | Smoak . | |
| 3,735,819 | 5/1973 | Ramsey . | |

FOREIGN PATENT DOCUMENTS

| | | | |
|---|---|---|---|
| 107632 | 6/1939 | Australia | 173/126 |

*Primary Examiner*—Frank T. Yost

*Attorney, Agent, or Firm*—King and Liles

[57] ABSTRACT

A driving pole for a ground rod or the like is provided wherein the ground rod is positioned in the hollow interior and driven into the ground in increments. Vertically spaced cross pins provide incremental stops for engaging the top of the ground rod for driving the rod into the ground as the pole is forced downwardly. The cross pins are preferably mounted on a bracket and spring biased into engagement tending to force the pin into the stop position. After each driving increment, the pole is raised, preferably with a rapid movement, the ground rod moves downwardly relative to the pole and the next lower pin 20 snaps into position for engagement with the top of the rod for driving. The biasing spring is mounted within the U-shaped bracket and a handle is provided for retracting the pins with a latch for holding the pins in the retracted position for insertion of the ground rod.

9 Claims, 3 Drawing Figures

GROUND ROD DRIVING POLE

BACKGROUND ART

The present invention relates to a tool for driving an elongated rod into the ground, and more particularly, to a driving pole having a hollow interior to receive a ground rod or the like and a plurality of stop pins along the length to engage the top of the pole for driving.

Line crews for utility companies must install ground rods at the base of each utility pole and other installations where lightening might strike. The ground rod is typically approximately eight feet in length and is driven into the ground so that the top is a few inches below the surface. Typically, these ground rods are installed by hand by a crew member using a sledge hammer. However, this is a tedious and time-consuming job. Furthermore, hitting the small ground rod with a sledge hammer is very dangerous and many a workman has been injured when the head of the sledge hammer misses the top of the rod and hits the arm or hand holding the ground rod. Nonetheless, to date, this is the most common way ground rods are installed by line crews.

There has been some effort to develop a tool for assisting in the ground rod driving process. The Caruthers et al U.S. Pat. No. 2,693,086 provides a ground rod driver having a tapered, segmented chuck for engaging the ground rod held inside the driver. The rod is driven in increments with the chuck being periodically released and the driver raised in order to allow the full length of the rod to be driven. This driver has not proven successful, insofar as I am aware, and it appears that the reason is the use of the relatively complicated chuck for engaging the ground rod. At best, the chuck is difficult to engage and release the rod requiring substantial time and effort on the part of the crew member. Furthermore, the engagement is by friction thereby allowing the driver to slip, particularly when hard ground or rock is encountered during the driving operation. It would be desirable to have a simplified and more effective ground rod driver. With this in mind, the present invention was developed.

DISCLOSURE OF INVENTION

Thus, it is a primary object of the present invention to provide a ground rod driving tool that is simple in design, relatively inexpensive to manufacture and is reliable in operation.

It is another object of the present invention to provide a ground rod driver utilizing a plurality of positive stop means positioned at spaced intervals along the driver to engage the top of the ground rod for driving.

It is another object of the present invention to provide a ground rod driving device wherein the rod may be quickly driven into the ground with essentially a single operator.

It is still another object of the present invention to provide a ground rod driving pole receiving the ground rod in the hollow interior and with positive engaging stop pins positioned at intervals along the pole and which are automatically engageable as the pole is raised after each driving stroke.

It is still another object of the present invention to provide a driving pole for a rod that can used either with a hydraulic boom or similar mechanical device, or manually.

The present invention provides a driving pole assembly or ground rod comprising a hollow pole for receiving the rod and laterally extending pin means on the pole for engaging the top of the ground rod. The pin means preferably comprises a plurality of cross pins positioned at spaced locations along the pole. Each pin in turn provides a stop for the top of the rod. The rod is driven into the ground in increments and after each stroke the pole is raised to allow the top of the rod to be positioned under the next lower pin on the next driving stroke.

The cross pins are mounted in lateral apertures positioned in the preferred embodiment approximately one foot apart in the vertical direction. Each aperture guides the pin into the stop position spanning the inside of the hollow pole. When the rod is being inserted, each pin may be withdrawn to allow easy insertion of the rod. Each pin is mounted in a U-shaped bracket and a guide hole is formed in the crosspiece of the bracket aligned with the aperture to receive and accurately guide the pin. A spring urges the pin across the pole into the stop position. With the rod inserted, and the pins released, the pins are urged against the side of the rod with the topmost pin snapping into stop position. As each increment of the rod is driven, the pole is raised allowing the next lower pin to snap into the stop position for driving.

In the preferred embodiment, a handle may be provided for each pin and a latch means provided to hold the pin in the withdrawn position as necessary. The latch means may comprise a slot in one leg of the support bracket to receive the handle. The handle may simply comprise a rod extending normal to the pin.

The driving pole preferably includes an outer casing for reinforcement. The apertures for the pin extends through one side of the casing adjacent the bracket and through both sides of the hollow pole. In this manner, firm support is provided for the pin at both ends to allow efficient driving of the rod.

Still other objects and advantages of the present invention will become readily apparent to those skilled in this art from the following detailed description, wherein I have shown and described only the preferred embodiments of the invention, simply by way of illustration of the best modes contemplated by me of carrying out my invention. As will be realized, the invention is capable of other and different embodiments, and its several details are capable of modification in various, obvious respects, all with departing from the invention. Accordingly, the drawings and description are to be regarded as illustrative in nature, and not as rectrictive.

BEST MODE FOR CARRYING OUT THE INVENTION

Figure 1:
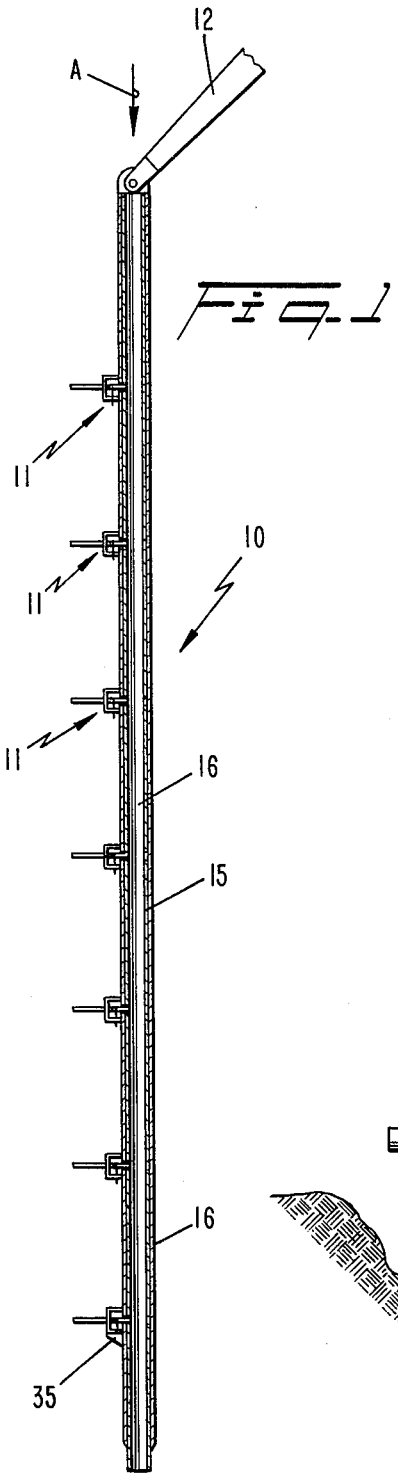
FIG. 1 is an overall side view of the driving pole assembly partially in cross section and supported by a driving boom.

Referring now to FIG. 1 of the drawing, a driving pole assembly 10 is provided and having a plurality of cross pin assemblies 11 positioned at vertical increments. The pole assembly 10 may be supported by an hydraulic boom 12 of the type usually found in a truck equipped for utility line installation. The same boom 12 is usually used for supporting an auger (not shown) for drilling a hole for the utility pole. The pole assembly 10 may be easily attached to the boom by a conventional pin and keeper thus providing easy and convenient setup for use.

Figure 3:
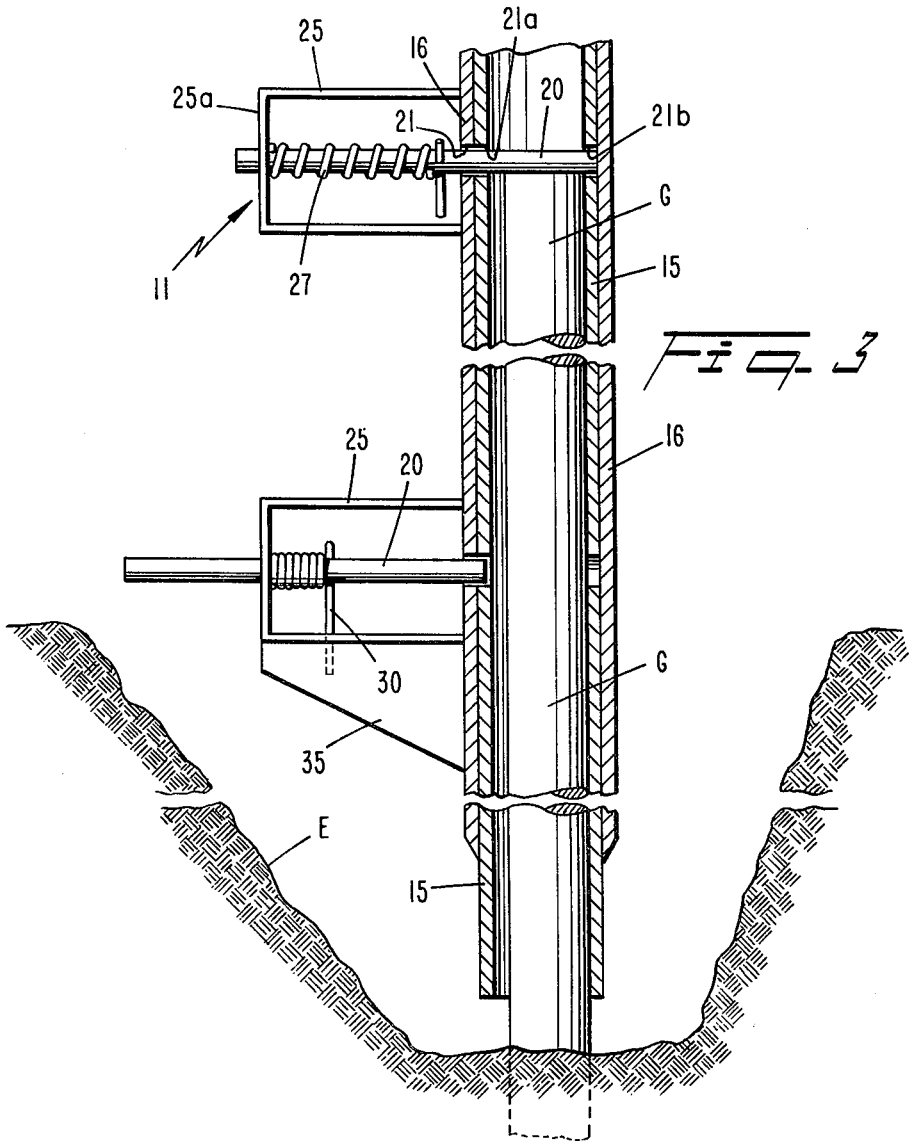
FIG. 3 is a cross sectional view of segments of the driving pole assembly showing the ground rod mounted in position with one cross pin retracted and one cross pin released into the stop position for driving.

The driving pole assembly 10 includes hollow pole 15 for receiving the ground rod G (see FIG. 3). The hollow pole is typically fabricated of a one and one half inch nominal size pipe. An outer casing 16 is provided for reinforcement of the pole 15. In a typical driving pole assembly, the casing may be fabricated of two inch nominal size pipe.

Each of the pin assemblies 11 includes a cross pin 20 extending through an aperture in one side of the casing 16 and through both sides of the inner pole 15. As best seen in FIG. 3, the aperture through the casing 16 is designated by the reference numeral 21 with the aperture in the sides of the pipe 15 being designed by the same numeral but with an added suffix; 21*a*, 21*b*. This lateral aperture 21, 21*a*, 21*b* advantageously provides secure placement of the pin 20 when in the driving position (note upper pin 20 in FIG. 3). The distal end of the pin 20 is securely held in the aperture 21*b* and the casing 16 adjacent the aperture 21*b* provides a limit stop for the pin 20 as it moves across into the operative position.

Figure 2:
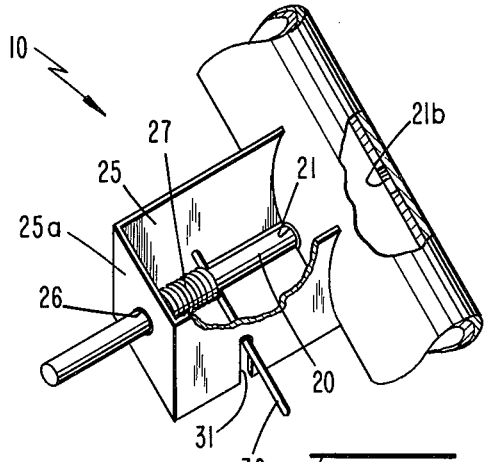
FIG. 2 is a perspective view with parts broken away for clarity showing a single cross pin and mounting bracket in detail.

Each pin 20 is mounted by a bracket 25 generally U-shaped in configuration and suitably welded to the side of casing 16. Crosspiece 25*a* of the bracket 25 is provided with a guide hole 26 for receiving the outer extension of the pin 20. The guide hole 26 assures the pin 20 is maintained in alignment with the aperture 21 at all times, even upon retraction, as shown in FIG. 2.

A compression spring 27 is positioned on the pin 20 between crosspiece 25*a* and handle 30. The spring normally urges the pin 20 toward the operative position wherein the pin extends across the hollow interior of pole 15 (see upper pin 20 in FIG. 3). The handle 30 is preferably a rod member extending normal to the pin through a mounting aperture. The handle is grasped at the end and pulled away from the side of the pole assembly 10 in order to retract the cross pin 20. A latching slot 31 is formed in one leg of the bracket 25 (see FIG. 2) so that upon retraction of the pin 20 and rotation at the full retracted position, the handle 30 may be secured in place. The retracted position of pin 20 is shown in FIG. 2 and by the bottom pin 20 of FIG. 3. As shown in FIG. 3, the distal end of the pin 20 retracts to a position substantially free of the hollow interior of the pole 15 so that the ground rod G may be easily inserted.

After the ground rod G is in position in the pole assembly 10, the operator simply releases the pin 20 by a flip of the handle 30 freeing the handle of the locking slot 31 and allowing the spring 27 to move the pin 20 against the side of the ground rod G (see dotted line position of lower pin 20 in FIG. 3). With a full length ground rod, in the fully inserted position, all of the pins 20 engage the side of the rod G as shown. Due to the spring force of the spring 27, the rod is temporarily held in the driving pole. During operation, the boom 12 is moved upwardly, preferably with a rapid motion so that the ground rod G slips downwardly relative to the pole assembly 10. When this is done, the uppermost cross pin assembly 11 is then above the end of the ground rod G and the pin 20 automatically shifts into the stop position (see upper pin assembly 11 in FIG. 3). The ground rod G is then ready for driving and a simple downward push on the boom 12 as shown by the arrow A in FIG. 1 effects the driving action.

The initial 12–15 inches of the ground rod G is accommodated in the ground by a quickly dug excavation E, as shown at the bottom of FIG. 3. This excavation allows the lower end of the pole assembly 10 to extend down below the ground level L and thus allows the full driving action of the ground rod G to be performed by the pole assembly 10 of the present invention. Because the lowermost cross pin assembly 11 may engage loose dirt or rocks in the excavation E, a reinforcing gusset 35 may be provided on the lower leg of the bracket 25, as shown in FIG. 1 and partially in the lower cross pin assembly 11 of FIG. 3.

From the foregoing description, it should now be apparent that substantial results and advantages over the prior art are obtained by utilizing the pole assembly 10. The ground rod G is easily insertable into the hollow interior of the pole 15 with the cross pins 20 withdrawn and latched by the handles 30. The pins are released for engagement with the ground rod G and upon upward movement of the pole assembly 10 the uppermost pin 20 automatically engages the top of the ground rod for commencing the incremental driving operation. As each increment of the ground rod is driven into the ground, the sharp upward movement of the boom 12 shifts the rod relative to the pole 15 bringing the next lower pin 20 into the stop position. Each pin 20 provides a positive stop that cannot slip as is possible with the prior art chuck. Of course, the pole assembly 10 may be operated manually, by simply setting into position the desired pin 20 and raising and lowering the pole assembly 20 to drive the rod by impact engagement with the pin 20. In the manual operation, or in a situation where the ground is unusually soft, it may be desirable to leave the pins 20 in the release position when the pole assembly 10 is raised to engage the next lower pin 20.

The pole assembly 10 is simple in construction and is thus relatively low cost to manufacture and repair. Furthermore, dirt and debris can be easily cleaned from the driving pole assembly. Extended use as well as accumulation of dirt and the like does not adversely effect the positioning of the pins 20 and thus the pole assembly 10 is highly reliable and virtually maintenance-free. Since the pins can be released and automatically snapped into position in sequence, the pole assembly 10 provides a one-man operation whereas in the past two or three men have been required.

In this disclosure, there is shown and described only the preferred embodiments of the invention, but as aforementioned, it is to be understood that the invention is capable of use in various other combinations and environments and is capable of changes or modifications within the scope of the inventive concept as expressed herein.

I claim:

1. A driving pole assembly for a ground rod or the like comprising:

a hollow pole for receiving the rod, and adjustable means extending across the interior of said pole at spaced locations along the pole to selectively provide a stop for the top of said rod, whereby said rod may be driven in increments into the ground upon applying repeated series of downward forces to said pole.

2. The pole of claim 1, wherein said adjustable stop means comprises a plurality of cross pins at spaced locations along said pole, each pin being mounted in a lateral aperture through said pole, and means for withdrawing each pin to allow insertion of said pole, whereby the rod may be driven in increments.

3. The pole of claim 2, wherein each pin is mounted by a U-shaped bracket, and a guide hole in the crosspiece of said bracket aligned with said aperture to receive said pin.

4. The pole of claim 3, wherein a spring is provided for each pin to urge the pin across the pole toward the rod stop position, said spring mounted in said bracket and acting against said crosspiece, whereby said pins are urged against the side of said rod with the operative pin snapping into stop position upon upward movement of said pole.

5. The pole of claim 4, wherein is provided a handle for each pin, latch means for said handle to hold said pin in the withdrawn position against the force of said spring.

6. The pole of claim 5, wherein said latch means includes a slot in one leg of said bracket to receive said handle.

7. The pole of claim 6, wherein said handle comprises a rod member extending normal to said pin, said rod being positionable in the latching slot.

8. The pole of claim 2, wherein is provided an outer casing for said pole for reinforcement.

9. The pole of claim 8, wherein said aperture for said pin extends through one side of said casing and through both sides of said pole, whereby said pin is held at both ends in the stop position.

* * * * *